United States Patent [19]

von der Crone et al.

[11] 4,427,752

[45] Jan. 24, 1984

[54] USE OF ISOINDOLINE PIGMENTS FOR PHOTOELECTROPHORETIC IMAGING

[75] Inventors: Jost von der Crone, Riehen; Werner Sieber, Basel, both of Switzerland

[73] Assignee: Ciba-Geigy Corporation, Ardsley, N.Y.

[21] Appl. No.: 372,781

[22] Filed: Apr. 28, 1982

[30] Foreign Application Priority Data

May 8, 1981 [CH] Switzerland ..... 2997/81

[51] Int. Cl.[3] ..... G03G 17/04

[52] U.S. Cl. ..... 430/37; 430/38

[58] Field of Search ..... 430/37, 38, 32

[56] References Cited

U.S. PATENT DOCUMENTS

| | | |
|---|---|---|
| 3,384,488 | 5/1968 | Tulagin et al. . |
| 3,384,565 | 5/1968 | Tulagin et al. . |
| 3,384,566 | 5/1968 | Clark . |
| 3,385,480 | 5/1968 | Tidwell . |
| 3,447,922 | 6/1969 | Weinberger . |
| 3,646,033 | 2/1972 | Leister et al. . |
| 3,794,659 | 2/1974 | Leister et al. . |
| 4,191,566 | 3/1980 | Jeanneret et al. . |
| 4,219,614 | 8/1980 | Stahly . |
| 4,262,120 | 4/1981 | von der Crone . |

*Primary Examiner*—John E. Kittle
*Assistant Examiner*—John L. Goodrow
*Attorney, Agent, or Firm*—Luther A. R. Hall

[57] ABSTRACT

A photoelectrophoretic imaging process, wherein a suspension of photosensitive pigment particles between two electrodes, at least one of which is transparent, is subjected to the influence of an electric field and exposed to an image, which process comprises using, as photosensitive pigment, an isoindoline of the formula

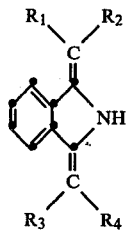

(I)

wherein $R_1$ and $R_3$ are cyano, —COOR or —CONHR′, in which R is alkyl, cycloalkyl, aryl or a heterocyclic aromatic radical, and R′ is hydrogen, alkyl, cycloalkyl, aryl or a heterocyclic aromatic radical, $R_2$ and $R_4$ are cyano, or wherein $R_3$ and $R_4$, together with the carbon atom linking them, form a heterocyclic 6-membered ring.

The pigments used in this invention are distinguished by particularly good photoelectrophoretic sensitivity and low fog density.

12 Claims, No Drawings

USE OF ISOINDOLINE PIGMENTS FOR PHOTOELECTROPHORETIC IMAGING

It is known that photoelectrophoretic imaging processes constitute a subclass of electrophotographical reproduction processes. They can also be used for reproducing monochrome or multicolour half-tone or line image originals. Photoelectrophoretic imaging processes are described e.g. in U.S. Pat. Nos. 3,384,565, 3,384,566 and 3,384,488. A feature common to all photoelectrophoretic processes is the use of particulate material which acts simultaneously as recipient of the electromagnetic radiation that imparts the image information, and as medium for the image fixed on the final carrier. The particles must therefore simultaneously be electrically photosensitive and have a surface colour suitable for imaging. When reducing the principle of photoelectrophoresis to actual practice, the procedure normally comprises suspending pigment particles, i.e. insoluble light-absorbing particles, in an electrically insulating carrier vehicle, desirably an aliphatic hydrocarbon. This suspension is applied between two electrodes, one of which may be transparent. An electrical current is applied to the electrodes, so that the pigment particles are subjected to the influence of an electric field. In certain embodiments of the process, the electric field can also be produced or modified by a corona discharge. In addition, an alternating field may be superimposed on the time-constant field. The suspension can then be irradiated—e.g. through the transparent electrode—by exposure to the activating radiation carrying the image information. Irradiation may also be effected in certain cases shortly before the electric field is applied. The particles then exhibit their electrical photosensitivity by depositing on one or other of the electrodes, depending on the intensity of the radiated light. The result is that a positive image is formed on one electrode and a negative image is formed on the other.

Ideally, all the particles deposit in the dark on one electrode, so that the electrode opposite, which throughout this specification is referred to as the "image electrode", has a deposit of pigment only at those areas where it has been irradiated. If this condition is not fulfilled, then the image is more or less densely fogged, i.e. it has an alien background.

The distinct particle deposit described above can be promoted by means of so-called charge control agents, e.g. as described in U.S. Pat. No. 4,219,614 (Frederick A. Staley, Eastman Kodak Company). These charge control agents have often been selected from liquid toner systems of electrostatic copying processes. They usually consist of molecules which contain a readily ionisable part and a part which is readily compatible (i.e. non-polar) with the suspension vehicle. Very suitable charge control agents are the calcium petroleum sulfonates which are available e.g. from Orogil S.A. (France) under the registered trademark OLOA 246F®. These compounds are calcium salts of aromatic sulfonic acids having a long linear hydrocarbon chain. The molecular weight is about 1000. The charge control agents often simultaneously act as dispersants, e.g. they cause an improvement in the spatial distribution of the pigment particles in the suspension. This property has in turn a positive influence on the resolution of the reproduction process. A further improvement in the state of the dispersion as well as a fixation of the pigment particles on the image carrier after evaporation of the suspension vehicle, may be obtained with polymeric additives which are soluble in the suspension vehicle. As examples there may be mentioned poly(12-hydroxystearic acid), polyisobutylene, dodecyl polymethacrylate, octadecyl polymethacrylate and polyvinyl toluene.

All the aforementioned requirements of photoelectrophoretic reproduction processes apply both to monochromatic and to multicolour image reproduction. In multicolour processes, a distinction may be made between simultaneous and sequential processes. In the former, the suspensions employed contain particles of different colours in appropriate admixture, whereas in the latter, particles of one colour at a time deposit in succession to form an image on the same substrate. Common to all multicolour processes, however, is the requirement that the particles must be selectively sensitive to specific spectral areas of the electromagnetic radiation. In order to obtain an exact coloured reproduction of the original, the particles should be selectively electrically photosensitive to that spectral area which corresponds to their main absorption region.

As reference value for the photoelectrophoretic sensitivity of a reproduction system there may be chosen e.g. the minimum light intensity required to obtain a specific density of pigment particles on the image electrode. Ideally this light intensity is as small as possible, whereas on the other hand, as already mentioned, no particles should deposit on the image electrode without irradiation.

Up to now, few yellow pigments are known that meet the aforementioned requirements even only approximately and which at the same time have a pure shade, high tinctorial strength and light fastness. The greatest shortcoming of the yellow pigments of the prior art, however, is that, in the absence of a charge control agent, they result in heavily flocculated suspensions and cause a dense fog on the image electrode, and that, in the presence of a charge control agent, they are greatly impaired in their photoelectrophoretic sensitivity. Systems which contain the pigments described below of this invention are distinguished by particularly good photoelectrophoretic sensitivity and low fog density.

Accordingly, the present invention relates to a photoelectrophoretic imaging process, wherein a suspension of photosensitive pigment particles between two electrodes, at least one of which is transparent, is subjected to the influence of an electric field and exposed to an image, which process comprises using, as photosensitive pigment, an isoindoline of the formula

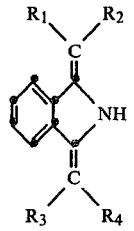

(I)

wherein $R_1$ and $R_3$ are cyano, —COOR or —CONHR', in which R is alkyl, cycloalkyl, aryl or a heterocyclic aromatic radical, and R' is hydrogen, alkyl, cycloalkyl, aryl or a heterocyclic aromatic radical, $R_2$ and $R_4$ are cyano, or wherein $R_3$ and $R_4$, together with the carbon atom linking them, form a heterocyclic 6-membered ring.

Where $R_1$ and $R_3$ in the compound of formula (I) are —COOR or —CONHR, R is preferably $C_1$–$C_6$alkyl, $C_5$–$C_6$cycloalkyl, phenyl or phenyl substituted by halogen, $C_1$–$C_4$alkyl or alkoxy. Typical examples of heterocyclic radicals R are pyridyl, quinolyl, benzimidazolyl, benzoxazolyl or benzthiazolyl. A heterocyclic ring formed by $R_3$ and $R_4$ together with the carbon atom linking them is preferably a 4,6-dioxotetrahydropyrimidine, 2,4-dioxo-5-methyl-1,2,3,4-tetrahydropyridine or 2,4-dioxo-1,2,3,4-tetrahydroquinoline radical.

Preferred isoindolines are those of the formula

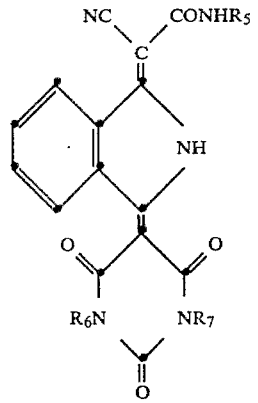

(II)

wherein $R_5$, $R_6$ or $R_7$ is hydrogen, $C_1$–$C_4$alkyl, phenyl or phenyl substituted by halogen, $C_1$–$C_4$alkyl or $C_1$–$C_4$alkoxy, and, in particular, the isoindoline of the formula (II), wherein $R_5$ is methyl and $R_6$ and $R_7$ are hydrogen.

Most of the aforementioned pigments of the formula I are known compounds which can be obtained by the processes described in French patent specification No. 1 537 299, e.g. starting from 1,3-diiminoisoindoline in accordance with the following reaction scheme:

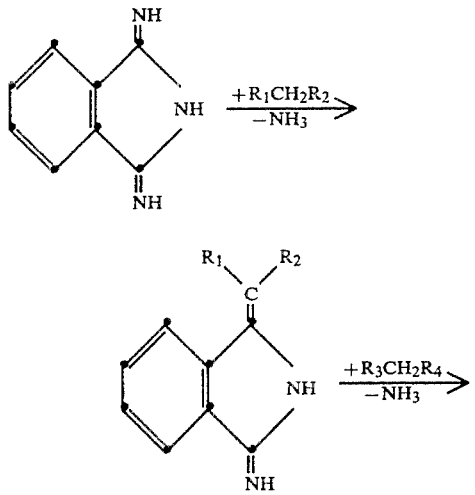

-continued

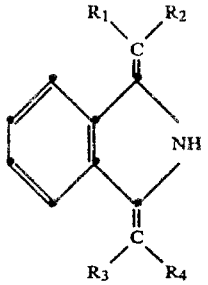

The compounds of the formula (II) can be obtained by the process described in German Offenlegungsschrift No. 2 814 526, by reacting a compound of the formula

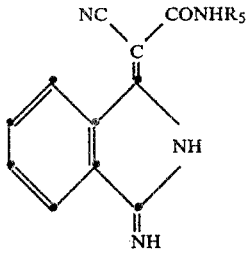

in which $R_5$ has the given meaning, with the corresponding barbituric acid.

The pigments are preferably in finely particulate form, with the average particle size conveniently being less than 10μ and advantageously between 0.1 and 5μ. It is advantageous if the particles are of uniform size.

The pigments are expediently used together with a charge control agent. Suitable charge control agents are, in particular, the calcium salts of aromatic sulfonic acids, the aromatic radical of which contains a long-chain linear hydrocarbon radical. Further additives which it is advisable to use in the liquid suspension, especially for fixing the pigment on the image carrier, are soluble polymers such as polyisobutylene, polyvinyl toluene, dodecyl or octadecyl polymethacrylate, and poly(12-hydroxystearic acid).

The invention is illustrated by the following Examples, in which parts and percentages are by weight, unless otherwise indicated.

EXAMPLE 1

8 parts of the isoindoline of the formula II ($R_5$=methyl, $R_6$ and $R_7$=H) are ground with 100 parts of Isopar G ® (saturated aliphatic hydrocarbon) for 4½ hours in a laboratory sand mill. The resultant suspension is adjusted to 6% by weight. 1 part of this suspension, 2 parts of a 1% solution of OLOA 246F ® in Isopar G ® and 7 parts of Isopar G ® are mixed and dispersed in an ultrasonic bath. The pigment suspension is tested in an exposure apparatus consisting of two transparent, parallel Nesa glass electrodes spaced 100 μm apart. The electrode surface is 10 $cm^2$ and the electrical voltage applied is 1050 volts. One half of the electrode surface is exposed using a projector and the other half is dimmed. After exposure and separation of the electrodes, the optical density on the electrode opposite to the incidence of light is measured with a spectrophotometer at the maximum absorption of the pigment, which is 475 nm. The optical density on the dimmed half is referred to hereinafter as "fog density", and the optical density on the exposed half is referred to as the "image density". The results are reported in the following table:

| Exposure: | Optical density: |
|---|---|
| 0 (fog) | 0.043 |
| 2000 l × sec | 0.344 |
| 8700 l × sec | 1.105 |

EXAMPLE 2

The pigment suspension obtained in Example 1 is left to stand in the dark for 12 days before the test. The results of the test are reported in the following table:

| Exposure: | Optical density: |
|---|---|
| 0 (fog) | 0.024 |
| 646 l × sec | 0.564 |
| 2000 l × sec | 1.100 |

EXAMPLE 3

20 parts of the isoindoline of formula (III) ($R_5$=methyl, $R_6$ and $R_7$=H) are dispersed, under ultrasonic irradiation, in 1500 parts by volume of isopropanol/water (1:4) and centrifuged off. This operation is repeated again twice with fresh solvents. The pigment is vacuum dried. A 6% dispersion of the purified pigment in Isopar G® is prepared in a laboratory sand mill. 1 part of this 6% dispersion, 1 part of a 1% solution of OLOA 246F®, 1 part of a 20% solution of poly(12-hydroxystearic acid) in Isopar G® and 7 parts of Isopar G® are mixed and the mixture is left to stand for 1 day in the dark and then tested as in Example 1. The results are reported in the following table:

| Exposure: | Optical density: |
|---|---|
| 0 (fog) | 0.054 |
| 200 l × sec | 0.386 |
| 646 l × sec | 1.172 |
| 2000 lxsec | 1.769 |

EXAMPLE 4

The pigment of formula II ($R_5$=methyl, $R_6$ and $R_7$=H) is purified as in Example 3. A 6% dispersion of the purified pigment in Isopar G® is prepared in a laboratory sand mill.

1.5 parts of 2,2,5,5-tetramethyl-4-benzoylpiperidine-N-oxide are dissolved in 70 parts of Isopar G®, and 10 parts of the above 6% pigment suspension, 10 parts of a 1% solution of OLOA 246F® and 10 parts of a 20% solution of poly(12-hydroxystearic acid) in Isopar G® are admixed under ultrasonic irradiation. In a reflux apparatus, highly purified nitrogen is introduced into the suspension at 80° C. over 72 hours. After it has cooled, the suspension is tested as in Example 1. The results are reported in the following table:

| Exposure: | Optical density: |
|---|---|
| 0 (fog) | 0.012 |
| 648 l × sec | 0.244 |
| 2000 l × sec | 0.785 |

-continued

| Exposure: | Optical density: |
|---|---|
| 12000 l × sec | 1.622 |

EXAMPLE 5

The pigment suspension described in Example 4 is tested in an imaging system consisting substantially of a horizontal, planar Nexa glass electrode and a steel roller coated with paper. The roller moves over the plate covered with the suspension while the plate is exposed from below to an image. In this instance, exposure is made through a neutral grey step wedge from below onto the transparent electrode, whilst a voltage of 700 volts is applied between the plate and the roller. The image reproduction formed on the paper is evaluated by reflectance densitometry, resulting in a fog density of 0.0, a sensitivity of 50 l×sec and a maximum image density of 0.4. The slope of the characteristic curve $\gamma$ is about 0.9. The properties of the suspension are retained over several months.

EXAMPLE 6

3.5 parts of the isoindoline of formula II ($R_5$=methyl, $R_6$ and $R_7$=H) are ground with 46.5 parts of Isopar G® for 96 hours in a laboratory ball mill with steatite balls. 6.8 parts of the resultant dispersion, 8 parts of a 1% solution of OLOA 246F® and 20 parts of a 6% solution of poly(12-hydroxystearic acid) in Isopar G® are mixed with 5.2 parts of Isopar G® under ultrasonic irradiation. The resultant dispersion is tested in the imaging system as in Example 5. The fog density is 0.14, the sensitivity 11 l×sec, the maximum image density 0.8 and the slope of the characteristic curve is 0.46.

EXAMPLE 7

The procedure of Example 6 is repeated, except that a "Kodacolor®" coloured negative is projected onto the transparent electrode through a Kodak Wratten® 47 filter. The image on the paper is dried and the transparent electrode cleaned, and then magenta and cyan components are applied in similar manner. A polychromatic image of good resolution and half-tone reproduction is obtained.

EXAMPLE 8

A 6% dispersion of the isoindoline of formula I ($R_2$=$R_4$=CN, $R_1$=$R_3$=$CONH_2$) is prepared in Isopar G® in a laboratory sand mill. 2 parts of this 6% dispersion, 4 parts of a 1% solution of OLOA 246F®, 2.6 parts of a 23% solution of poly(12-hydroxystearic acid) and 21.4 parts of Isopar G® are mixed under ultrasonic irradiation. The resultant suspension is tested as in Example 1. The results are reported in the following table:

| Exposure: | Optical density: |
|---|---|
| 0 (fog) | 0.011 |
| 200 l × sec | 0.158 |
| 2000 l × sec | 0.316 |

EXAMPLE 9

A 6% dispersion of the isoindoline of formula I ($R_2$=$R_4$=CN, $R_1$=$R_3$=$CONH_2$) in Isopar G® is prepared in a laboratory sand mill. 2 parts of this pigment dispersion, 1.5 parts of a 1% solution of OLOA 246F ® in Isopar G ® and 16.5 parts of Isopar G ® are mixed together under ultrasonic irradiation. The mixture is tested as in Example 1. The results are reported in the following table:

| Exposure: | Optical density: |
|---|---|
| 0 (fog) | 0.055 |
| 200 I × sec | 0.149 |
| 1730 I × sec | 0.575 |

EXAMPLES 10, 11 AND 12

Each of the following isoindolines (a) of the formula I ($R_5$=ethyl, $R_6$=$R_7$=H), (b) of the formula I ($R_1$ and $R_2$=—CN, $R_3$ and $R_4$ together=—CO—NH—CO—NH—CO—), (c) of the formula I ($R_2$=—CN, $R_1$=$COOCH_3$, $R_3$ and $R_4$ together=—CO—NH—CO—NH—CO—)

is ground in Isopar G ® for 4½ hours in a laboratory sand mill to give an 8% dispersion. The pigment concentration is then adjusted to 6%. Each of the three dispersions is then used as follows:

2 parts of the 6% dispersion, 5 parts of a 1% solution of OLOA 246F ® in Isopar G ® and 13 parts of Isopar G ® are mixed under ultrasonic irradiation. The resultant dispersion is tested as in Example 1. The results are reported in the following table:

| | Optical density: | | |
|---|---|---|---|
| Exposure: | a. | b. | c. |
| 0 (fog) | 0.008 | 0.007 | 0.004 |
| 200 I × sec | 0.042 | 0.064 | 0.023 |
| 3070 I × sec | 0.513 | 0.412 | 0.483 |

EXAMPLE 13 (PRIOR ART)

A 6% dispersion of N-2″-pyridyl-8,13-dioxonaphthol(2,1-b;2′,3′-d)-furan-6-carboxamide is prepared in a laboratory sand mill. 2 parts of this 6% dispersion, 3 parts of a 1% solution of OLOA 246F ® in Isopar G ® and 15 parts of Isopar G ® are mixed under ultrasonic irradiation. The resultant dispersion is tested as in Example 1. The results (average values and standard deviations from 4 measurements) are reported in the following table:

| Exposure: | Optical density: |
|---|---|
| 0 (fog) | 0.015 ± 0.006 |
| 1730 I × sec | 0.013 ± 0.002 |
| 10200 I × sec | 0.021 ± 0.004 |

EXAMPLE 14 (PRIOR ART)

2 parts of a 6% dispersion of the pgiment used in Example 13 in Isopar G ®, 1 part of a 1% solution of OLOA 246F ®, 10 parts of a 6% solution of poly(12-hydroxystearic acid) in Isopar G ® and 7 parts of Isopar G ® are mixed under ultrasonic irradiation. The resultant dispersion is tested as in Example 1. The results (average values and standard deviations) are reported in the following table:

| Exposure: | Optical density: |
|---|---|
| 0 (fog) | 0.180 ± 0.038 |
| 200 I × sec | 0.182 ± 0.034 |
| 3070 I × sec | 0.190 ± 0.028 |

What is claimed is:

1. A photoelectrophoretic imaging process comprising subjecting a liquid suspension of photosensitive pigment particles to an applied electric field between two electrodes, at least one of which is transparent, said electric field having a field strength of at least about $1.05\times10^7$ volts/meter, said suspension comprising a plurality of particles of pigment, said pigment being both the primary electrically photosensitive ingredient and the primary colorant for said particles, said particles having a particle size between 0.1 and 10 microns, wherein the pigment is an isoindoline of the formula

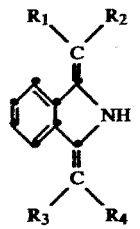

(I)

wherein $R_1$ and $R_3$ are cyano, —COOR or —CONHR′, in which R is alkyl, cycloalkyl, aryl or a heterocyclic aromatic radical, and R′ is hydrogen, alkyl, cycloalkyl, aryl or a heterocyclic aromatic radical, $R_2$ and $R_4$ are cyano, or wherein $R_3$ and $R_4$, together with the carbon atom linking them, form a heterocyclic 6-membered ring, and exposing said suspension to an image through said transparent electrode with a source of electromagnetic radiation whereby an image is formed.

2. A process according to claim 1, which comprises using an isoindoline of the formula (I) in which $R_1$ and $R_3$ are cyano, —COOR or —CONHR′, in which R is $C_1$–$C_4$-alkyl and R′ is hydrogen or $C_1$–$C_4$-alkyl, $R_2$ and $R_4$ are cyano or wherein $R_3$ and $R_4$ form together the group —CONHCONHCO—.

3. A process according to claim 1, which comprises using an isoindoline of the formula

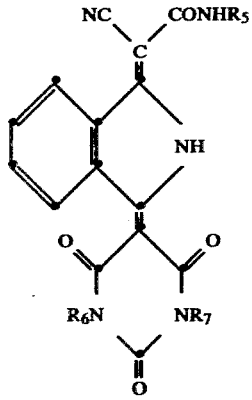

(II)

wherein $R_5$, $R_6$ or $R_7$ is hydrogen, $C_1$–$C_4$alkyl, phenyl or phenyl substituted by halogen, $C_1$–$C_4$alkyl or $C_1$–$C_4$alkoxy.

4. A process according to claim 3, which comprises using an isoindoline of the formula II, wherein $R_5$ is methyl, and $R_6$ and $R_7$ are hydrogen.

5. A process according to claim 1, which comprises using an isoindoline of the formula

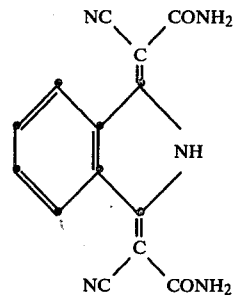

6. A process according to claim 1, wherein a charge control agent is used as additional substance.

7. A process according to claim 6, wherein the calcium salt of an aromatic sulfonic acid containing a long chain linear hydrocarbon radical in the aromatic moiety is used as charge control agent.

8. A process according to claim 1, wherein a polymer which is soluble in the liquid suspension is used as additional substance.

9. A process according to claim 8, wherein the polymer is poly(12-hydroxystearic acid).

10. A process according to claim 1, wherein the pigment has a particle size of 0.1 to 5$\mu$.

11. A process according to claim 6 wherein a polymer which is soluble in the liquid suspension is used as additional substance.

12. A process according to claim 11 wherein the polymer is poly(12-hydroxystearic acid).

* * * * *